US006691894B2

(12) United States Patent
Chrisman et al.

(10) Patent No.: US 6,691,894 B2
(45) Date of Patent: Feb. 17, 2004

(54) DISPENSING DEVICE FOR FOOD PRODUCT

(75) Inventors: Randall C. Chrisman, Southbury, CT (US); J. Antonio Gutierrez, Kent, CT (US); William F. Overbaugh, Lakeside, CT (US)

(73) Assignee: Nestec S.A., Vevey (CH)

( * ) Notice: Subject to any disclaimer, the term of this patent is extended or adjusted under 35 U.S.C. 154(b) by 176 days.

(21) Appl. No.: 10/068,217

(22) Filed: Feb. 6, 2002

(65) Prior Publication Data

US 2002/0092879 A1 Jul. 18, 2002

Related U.S. Application Data

(63) Continuation of application No. PCT/EP00/07465, filed on Aug. 1, 2000, and a continuation-in-part of application No. 09/392,463, filed on Sep. 9, 1999, now Pat. No. 6,196,420.

(51) Int. Cl.[7] ..... B65D 35/28
(52) U.S. Cl. ..... 222/101; 222/105
(58) Field of Search ..... 222/95, 101, 102, 222/105; B65D 35/28

(56) References Cited

U.S. PATENT DOCUMENTS

| | | | | | |
|---|---|---|---|---|---|
| 1,479,101 | A | * | 1/1924 | Legendre | 222/102 |
| 1,556,437 | A | | 10/1925 | Granger | 222/101 |
| 1,728,147 | A | * | 9/1929 | Winsor | 222/102 |
| 1,793,787 | A | | 2/1931 | Ertola | |
| 1,861,528 | A | * | 6/1932 | Hadden | 222/101 |
| 2,543,667 | A | | 2/1951 | Palmer | 222/101 |
| 2,545,342 | A | * | 3/1951 | Choquette | 222/101 |
| 2,570,755 | A | | 10/1951 | Booth | 222/101 |
| 2,837,243 | A | | 6/1958 | Zebink | 222/101 |
| 2,963,006 | A | | 5/1960 | Henley | 222/101 |
| 3,289,893 | A | * | 12/1966 | Vance et al. | 222/102 |
| 3,780,911 | A | * | 12/1973 | Paige | 222/101 |
| 4,223,809 | A | | 9/1980 | Martin | 222/101 |
| 4,418,840 | A | * | 12/1983 | Gardner, Sr. | 222/102 |
| 4,551,139 | A | | 11/1985 | Plaas et al. | 604/290 |
| 4,639,251 | A | * | 1/1987 | Kirkland | 222/102 |
| 4,921,139 | A | | 5/1990 | Fischer et al. | 222/129.1 |
| 5,215,218 | A | | 6/1993 | Choi | 222/63 |
| 5,292,031 | A | | 3/1994 | Dagan | 222/105 |
| 5,377,871 | A | * | 1/1995 | Banks et al. | 222/101 |
| 5,490,613 | A | * | 2/1996 | Taylor et al. | 222/102 |
| 5,634,343 | A | | 6/1997 | Baker, III | 222/146.6 |
| 5,676,279 | A | * | 10/1997 | Bastion | 222/102 |
| 5,692,645 | A | * | 12/1997 | Ryu | 222/101 |
| 5,833,120 | A | * | 11/1998 | Evans, Sr. et al. | 222/105 |
| 6,056,158 | A | | 5/2000 | Rossetti et al. | 222/95 |
| 6,196,420 | B1 | | 3/2001 | Gutierrez et al. | 222/101 |

FOREIGN PATENT DOCUMENTS

| | | |
|---|---|---|
| CA | 1 218 340 | 2/1987 |
| DE | 58 419 | 8/1891 |
| DE | 44 16089 | 10/1995 |
| EP | 0 798 264 A1 | 10/1997 |
| FR | 1 386 519 | 5/1965 |
| GB | 2 062 808 A | 5/1981 |
| WO | WO 92/18419 | 10/1992 |

* cited by examiner

*Primary Examiner*—Kenneth Bomberg
(74) *Attorney, Agent, or Firm*—Winston & Strawn LLP

(57) ABSTRACT

A dispenser for dispensing a viscous fluid food product from a pouch. The dispenser includes a housing configured and dimensioned for receiving the pouch. The pouch includes a food in the form of a viscous fluid therein. The pouch has first and second ends, a sidewall that can be arranged to form first and second opposed surfaces and an outlet. The dispenser incorporates an assembly that includes a roller for pressing the pouch so as to urge the viscous fluid food product toward the outlet. To do this, the roller has a pressing surface disposable in a position adjacent the first surface of the pouch and a planar surface disposed adjacent the second surface of the pouch. The dispenser also includes a closure assembly arranged for engagement with the outlet for closing same. This assembly is also capable of opening the outlet so as to cause the roller to move along the pouch surface toward the outlet by gravity for expelling the viscous fluid food product through the outlet.

27 Claims, 12 Drawing Sheets

FIG. 3
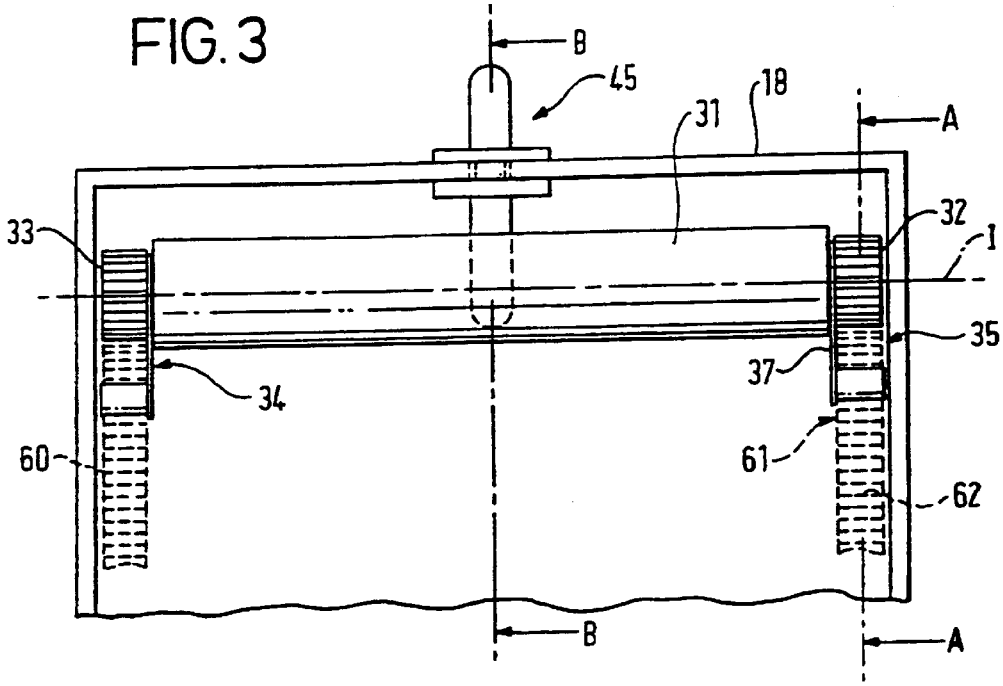
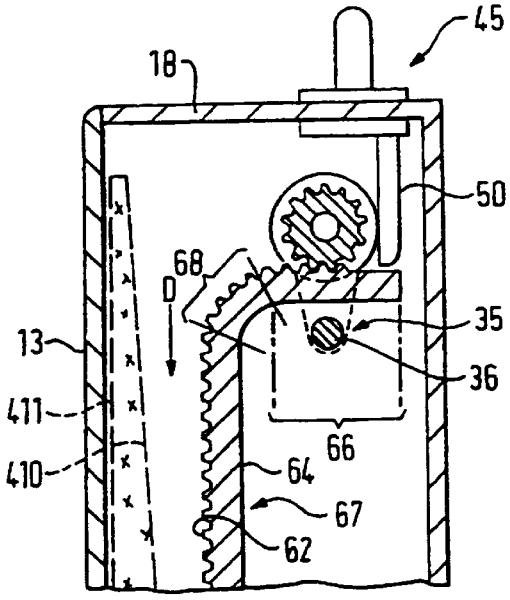
FIG. 4

DISPENSING DEVICE FOR FOOD PRODUCT

CROSS-REFERENCE TO RELATED APPLICATIONS

This application is a continuation of the U.S. national stage designation of International application PCT/EP00/07465 filed Aug. 1, 2000, and a continuation-in-part of U.S. application Ser. No. 09/392,463 filed Sep. 9, 1999, now U.S. Pat. No. 6,196,420, the content of each of which is expressly incorporated herein by reference thereto.

TECHNICAL FIELD

The present invention relates to the field of dispensing viscous and semi-viscous food products that do not flow sufficiently well by simple gravity force. In particular, the invention relates to dispensers adapted for receiving a removable supple bag or pouch containing a viscous liquid food such as sauce, condiment, cream and the like.

BACKGROUND

In the food service industry, it is desirable to serve a wide variety of viscous fluids such as sauce, mustard, ketchup, condiments, and the like in hygienic conditions and as conveniently as possible. For that, there are several known types of dispensing devices available.

Pump dispensers are commonly used. Ordinary, the foodstuff is moved and dispensed by controlled peristaltic action on a flexible hose connected to the pouch. However, there are several drawbacks to this system. In particular, the pouch must be equipped with a tubular resilient hose generally connected by a plastic fitment to the pouch that makes this combination pouch/fitment/hose rather costly to produce in mass production. Other disadvantages are obviously the extra-cost due to the addition of the pump in the dispenser and also the supplement in energy consumption.

Pumpless dispensers utilize both gravity and the mechanical force to dispense viscous fluids throughout the outlet of the bag. Such dispensing apparatuses provide an advantage of being capable of dispensing the food product without any motor actuated pumps. The pouch can also be made of two flat flexible sheets sealingly interconnected to define both the food storage reservoir and the outlet of the pouch. Such flat design is easy to manufacture and load, but such pumpless dispensers are subject to other drawbacks. These problems led to the widespread use of peristaltic pump dispensers in the foodservice industry despite their additional cost.

For instance, U.S. Pat. No. 5,833,120 to Evans, Sr. et al. discloses a pumpless cheese server being adapted to maintain inverted bags in a steam chamber while gravity influenced squeeze bars ride down the bag sides to express cheese toward the bag outlet fitment. More particularly, the pressure on the bag is carried out by a pair of squeeze rods that defines a bag receiving opening therebetween. The evacuation rate of the bag is relatively poor because of the presence of the opening that is necessary to permit the engagement of the bag between the squeeze rods. Therefore, a significant amount of food is left in the bag after the passage of the rods. Such an arrangement remains rather complicated and inconvenient when the empty bag has to be replaced by a new one. In particular, the pair of rollers has to be detached from the empty bag, then fitted to a new bag while taking care the rollers are not biased with respect to the bag which would cause blocking problems. In addition, when the bag is loaded with fluid product, it may be difficult to properly engage the pair of rollers through the upper portion of the bag. Furthermore, usual cheese or condiment bags can weigh in average 4–5 kilograms. Loading of the bag in the dispenser requires to manually lifting the bag so as to suspend the bag until locking the upper portion of the bag with hangers is performed. Depending upon the bag overall weight, this operation may be exhausting for the maintenance people.

U.S. Pat. No. 5,490,613 to Taylor et al. relates to a dispenser for viscous fluid having a hanging assembly for suspending a collapsible bag with a dispenser outlet extending from an opening at the bottom of a housing, and a pair of rollers riding in parallel pairs of slots vertically extending in opposite sides of the housing. Since the dispenser housing needs to be regulated in temperature to keep the bag warm or refrigerated, large side openings (or guide slots) in the housing are not desirable as it causes significant heat loss with the outside environment. Therefore, it takes more time to heat or cool a new bag to the required service temperature and the regulation is more energy consuming and safety or quality problems might occur more frequently. Furthermore, the housing is subjected more easily to introduction of dust, dirt and humidity that may cause important sanitary problems.

In this arrangement, the device also comprises a pair of rollers that can be separated when the housing is opened for engaging a new bag. However, the device is cumbersome as place for the two rollers must be saved accordingly. The rollers have to be joined by an elastic yoke provided on each external side of the housing making the arrangement complicated. Blocking problems are likely to occur, as the two rollers might not ride in a perfect parallel travel all along the length of the bag.

Moreover, loading of the bag also requires manual strength to lift the bag until it is properly suspended in the housing.

U.S. Pat. No. 5,297,699 to Barchus also relates to an internally-coupled dual roller tube squeezing device for fluid materials such as toothpaste, shampoo, adhesive, or the like.

U.S. Pat. No. 4,639,251 to Kirland relates to a flexible collapsible container containing medical liquids, a pair of rollers being arranged as a level indicator.

U.S. Pat. No. 5,578,001 to Sha is an infusion apparatus for IV bags comprising a squeezing arrangement of two parallel rollers.

Therefore there are needs for dispensers that:

A. provides optimal and satisfactory evacuation rates of the food product without any significant amount of the food is left and therefore wasted in the pouch.

B. are capable of increasing the temperature of the pouch rapidly and of maintaining temperature of the food pouch at a very precisely controlled value, e.g., either at warm temperature for cheese sauce or at refrigerated temperatures for milk products.

C. complies with the heath and quality regulations and is properly protected from dirt ingress during service and is easy to clean.

D. does not require particular skill or strength for the people responsible for keeping the system in service and therefore is easy to load with the pouch.

None of the devices discussed above provides a satisfactory solution that can be applied as a recognized efficient standard in the food service industry. Accordingly, there remains a need for improved dispensing devices in this area.

SUMMARY OF THE INVENTION

The present invention relates to a pumpless dispenser especially intended for dispensing viscous fluid food products. The dispenser includes a housing configured and dimensioned for receiving a food pouch. The pouch has first and second ends, a sidewall that can be arranged to form first and second opposed surfaces, and an outlet, and is capable of containing the food product therein. The dispenser includes a compression assembly for pressing the pouch so as to urge the viscous fluid food product content toward the outlet.

This assembly includes means for pressing the pouch to dispense the food product through the outlet. The pressing means advantageously comprises a man pressing assembly having sufficient mass to move along the pouch under the influence of gravity to thus induce a flow of food product through the pouch outlet upon demand. This assembly also includes a compressible pressing surface that is positionable adjacent the first surface of the pouch. The pressing means preferably includes roller means, which more preferably is a roller having engaging portions that form gear portions for guiding the roller along guide means that are provided on the housing. The guide means thus includes complementary engaging surfaces that form gear tacks for the engaging portion of the roller.

The dispenser also includes a planar surface disposed adjacent the second surface of the pouch, and closure means engaged with the outlet for closing the outlet. The closure means also can open the outlet so as to cause the roller to move along the pouch surface toward the outlet by gravity for expelling the viscous fluid food product through the outlet.

In one embodiment, the planar surface is substantially vertically arranged along at least a major portion of the length of the pouch. In a preferred embodiment, the planar surface constitutes an interior surface of at least a portion of wall of the housing. This arrangement is less cumbersome as the portion of wall can be made significantly thinner than an additional weighted roller. This arrangement is also lighter in weight than conventional dispensers and is less subjected to blocking problems as the number of moving parts is reduced.

In a more preferred embodiment, the housing comprises an openable door; the portion of wall comprising the planar surface is at least a portion of door. Therefore, the system can be deactivated and reactivated by simply manipulating the door in order to change the pouch and replace it by a new one. The maintenance is so limited to a minimum thus saving labor time and improving reliability of the dispenser. In addition, the thickness of the pouch is no more a concern, as the device is able to absorb a wider range of thickness than conventional dispensers.

The closure means advantageously comprises a clamping assembly for selectively pinching the outlet of the pouch and releasing pinching to control the dispensing of the viscous liquid food product. Therefore, desired quantity of food dispensed is achieved by actuation of the closure means. The opening of the closure means will start the roller motion along the pouch.

Preferable, the dispenser comprises guiding means that are complementary arranged with the roller so as to guide the roller means in translation along a pressing path adjacent the first surface of the pouch. The roller is arranged to have at least an outer portion that is compressible upon pressing onto the first surface of the pouch. Therefore, the roller has the ability to compress when in contact with the pouch thereby progressively flattening the pouch in a more uniform manner and leaving no possible gaps between the roller means and the surface of the pouch. As the pouch has a natural tendency to form wrinkles as it progressively empties, the compressibility of the roller allows the roller to roll over the wrinkles without significant blocking problems. Making the roller compressible gives the possibility to place the roller closer to the surface of the pouch while the roller compresses, thereby forming less product seepage past the roller and more consistent movement of the roller along the pouch during dispense of the food product. As a result, the evacuation or dispensing rate is significantly improved.

Preferably, the roller is formed of an elongated main cylindrical portion comprising an inner weight and an outer sheath of a soft resilient compressible material. Preferably, the sheath of compressible material has been determined to confer significant advantages in the reduction of the blocking problems due to the formation of wrinkles and in the increase of the evacuation rate especially when the hardness is comprised in the range of 25 to 45 shore A, more preferably 28 to 35 shore A, and even more preferably about 30 shore A. In a preferred embodiment, the soft resilient material is an insulated rubber. Insulation by the sheath reduces the heat transfer from the inside of the housing to the core of the roller, thereby decreasing time for heating or refrigerating the housing and further promoting the temperature control within the housing. Preferably rubber is silicone rubber. A preferable thickness for the sheath is about 4 to 10 mm, and more preferably 5 to 7 mm.

In a preferred mode, the roller means further includes an external gliding surface made of a plastic non-porous film. In this manner, the surface of contact of the roller means is also made smoother and more uniform which consequently positively influences the evacuation of the food product as compared to the soft surface of the sheath. The outer surface of the roller can also be cleaned more easily and the durability of the sheath is also increased. The film is preferably resistant to stretching and withstands contact under pressure with hot surfaces. Food grade mono- or multilayer polyolefin materials are preferred. The film should also perform a tight encasing of the sheath. The film is preferably adhered to the sheath by an adhesive or is thermally heat shrunk onto the sheath. A suitable film thickness is between about 0.4 to 1.5 mm, and preferably 0.8 to 1.2 mm.

In another aspect, the dispenser of the invention further has retaining means which are further coupled to the roller and arranged to prevent the roller from disengaging the guiding means and falling off the dispenser, in particular, when the dispenser is opened for pouch replacement. Both the guiding means and retaining means are housed within the housing, thereby providing a substantially closed dispensing device providing more sanitary guarantees and furthermore providing a system that is easier to both put and maintain the food pouch in the required range of temperatures for servicing. The retaining means also ensures a more reliable functioning of the dispenser and limits the manipulation of the roller, in particular, at the time when a depleted pouch needs to be replaced by a full one.

In a preferred embodiment, the guiding means comprises a pair of side guiding tracks arranged to complementary receive a pair of side engaging means of the roller. The guiding tracks are even preferably tracks comprising portions of gears. The retaining means is arranged to prevent the engaging means both from misaligning laterally with respect to the side guiding tracks and from significantly disengaging from the guiding track in a direction away from its translation path.

A third beneficial aspect of the invention relates to the ease of loading of the pouch. For this, the housing of the dispenser comprises at least one panel comprising a support surface adapted to receive the pouch in a position adjacent to the support surface. The panel is moveable between a loading position whereby the pouch is capable of being laid at rest on the support surface and a dispensing position whereby the outlet is in a downwardly oriented configuration. The dispenser further comprises connecting means for securing the pouch onto the support surface of the moveable panel so that the pouch is maintained substantially adjacent to the support surface when moving the panel from its loading position to its dispensing position. Therefore, this configuration avoids requiring the user to lift the pouch while securing it within the housing. This is an advantage because lifting of the pouch can be inconvenient or exhausting, as the pouch can be relatively heavy and/or cumbersome to handle.

In another embodiment, the connecting means includes at least one clamping assembly comprising a bar-shaped pressing member having a first end pivotally attached to the panel and a second end adapted to securely engage a latch member attached to the panel. The bar-shaped pressing member is capable of exerting a pressure along at least two spaced apart positions along a portion of the pouch. Preferably, the portion of the pouch is a seal flange portion of the pouch. By providing such clamping configuration, the pouch is secured in a more convenient and efficient way. As a result, a significant amount of time can be saved in the refill operation of the dispenser. A single motion also properly and rapidly secures the pouch from the user on the clamping assembly. Securing of the pouch in an area away from the housing also provides more convenience for adapting large pouches that would otherwise be difficult to secure directly by hanging the pouch within the housing.

A first clamping assembly is preferably positioned in the upper region of the panel for securing the upper seal flange of the pouch. A second clamping assembly may also be positioned in the lower region of the panel for securing at least one lower portion of the seal flange of the pouch. Both first and second assemblies have a width adapted to support differing sizes of pouch.

In an interesting aspect of the invention, the second clamping assembly can be part of the closure means that is capable of selectively opening and closing the outlet of the pouch upon dispensing of the food product. For that, the panel includes the closure means which are capable of engaging with the outlet of the pouch for closing the outlet, with the closure means being capable of opening the outlet to dispense the food product when sufficient pressure is exerted to release the closure means from the outlet of the pouch. The closure means preferably comprises a first spring-biased half valve sub-assembly attached to the moveable panel and a second half valve forming the stationary part of the closure means. The second half-valve preferably includes the bar shaped member of the clamping assembly which is arranged in a face-to-face relation with the first spring-biased half-valve when the clamping member is in closed position to secure the lower part of the pouch against the support surface of the panel.

The types of viscous fluid food products that can be dispensed from this dispenser include cheese sauce, tomato sauce, gravy, salad dressings, mustard, mayonnaise, ketchup, cream, Mexican sauce or salsa, condiments, nutritional supplements and concentrates, ice cream, or even partly frozen beverages. The invention also dispenses the product at a relatively high efficiency with less loss of food products in the bag and a higher controlled level of extrusion of the food product. Furthermore, the device can accommodate a wide range of pouch thicknesses while still exerting an effective squeezing pressure thereon.

The present invention thus provides a new pumpless dispensing unit which is low cost, more convenient to maintain than conventional dispensers and easy to use by the consumer. In particular, empty bags can be replaced by full ones with less manipulations, less efforts and more reliability. The time for changing the bag is reduced and this is very valuable during peak hours in food service establishments. The risks of blocking problems in the device are also reduced.

Additional advantages are provided when the food product to be dispensed is to be heated or cooled. The dispensing device provides a rapid and economic warm-up of the food products for those that are required to be served warm and, similarly, a rapid and economic cooling of the food products that are required to be served as chilled or partly frozen products.

In particular, the planar surface may advantageously be thermally coupled to a conductive heating or cooling device which provides thermal transfer to the planar surface for heating or cooling the food product in the pouch. The planar surface constitutes a significant surface of contact for the pouch which favors the thermal transfers so as to reduce calorific or frigorific loss and accelerate warm-up or cooling of the food product.

Preferably, the planar surface is coupled to a heating device comprising electrical resistance elements attached to the planar surface. More preferably, the heating device is adhesively secured on one side of the planar surface. The heating device may comprise adhesive strips or bands and electrical resistance elements connected therewith such as wires, mat or equivalents.

In another embodiment, the heating device also comprises convection means attached to the housing which provide heating by hot air circulating within the housing.

In an even more preferred embodiment, the air-forced convection heating means are used as primary source of heat in the dispenser and the conduction heating means are coupled to the planar surface as a supplementary source of heat to ensure a faster warm-up of the food product in the dispensing device.

In yet another embodiment, the dispenser comprises a cooling device using cold air-forced convection which can be used either alone or, even preferably, in combination with a supplementary thermoelectric cooler coupled to the planar surface.

The invention also relates to the pouch especially adapted for being used in the dispenser of the invention. The pouch comprises a main portion adapted for receiving a viscous fluid product, and an outlet portion integrally extending from the main portion. The main portion and the outlet portion are formed of at least one layer of flat plastic film securely sealed along at least a portion of peripheral seam in a substantially flat configuration. This arrangement of fitmentless pouch provides a uniform purge upon the passage of the roller while leaving a minimum remainder of food product within the pouch. The pouch can also be produced in a cost-effective manner by the commonly known method of form-fill-seal technique.

BRIEF DESCRIPTION OF THE DRAWINGS

The advantages and specific features of this invention will become apparent from a review of the following detailed description, which is provided in conjunction with the appended drawings figures, which disclose preferred embodiments of the present invention.

FIG. 3 is a partial front view of the dispenser showing the inside arrangement of the roller system and the pushing mechanism related thereto;

FIG. 4 is a schematic cross-sectional view taken along line A—A of the dispenser of FIG. 3;

DETAILED DESCRIPTION OF THE PREFERRED EMBODIMENTS

Figure 1:
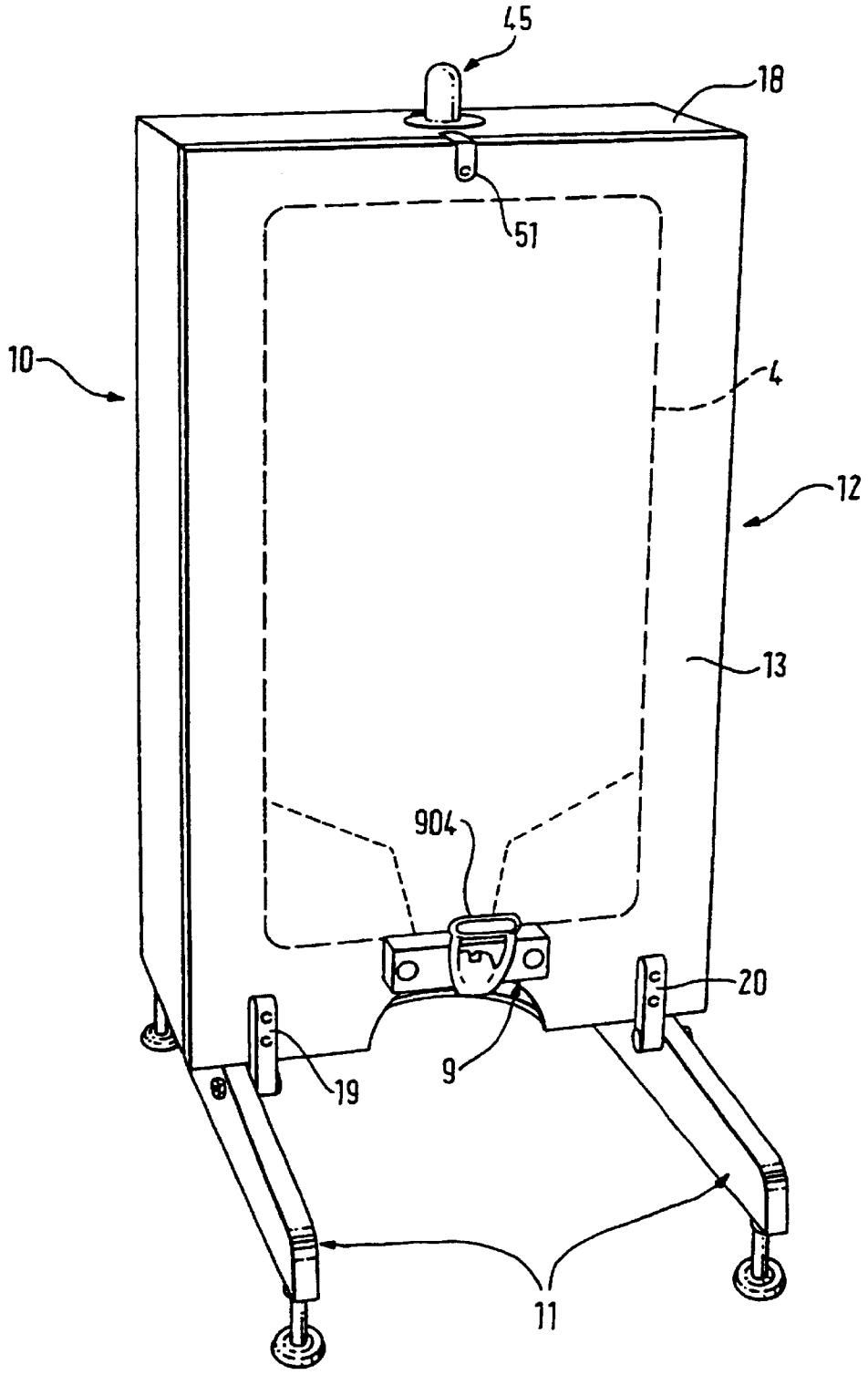
FIG. 1 is a perspective overall representation of the pumpless food dispenser according to the concept of the present invention.
Figure 2:
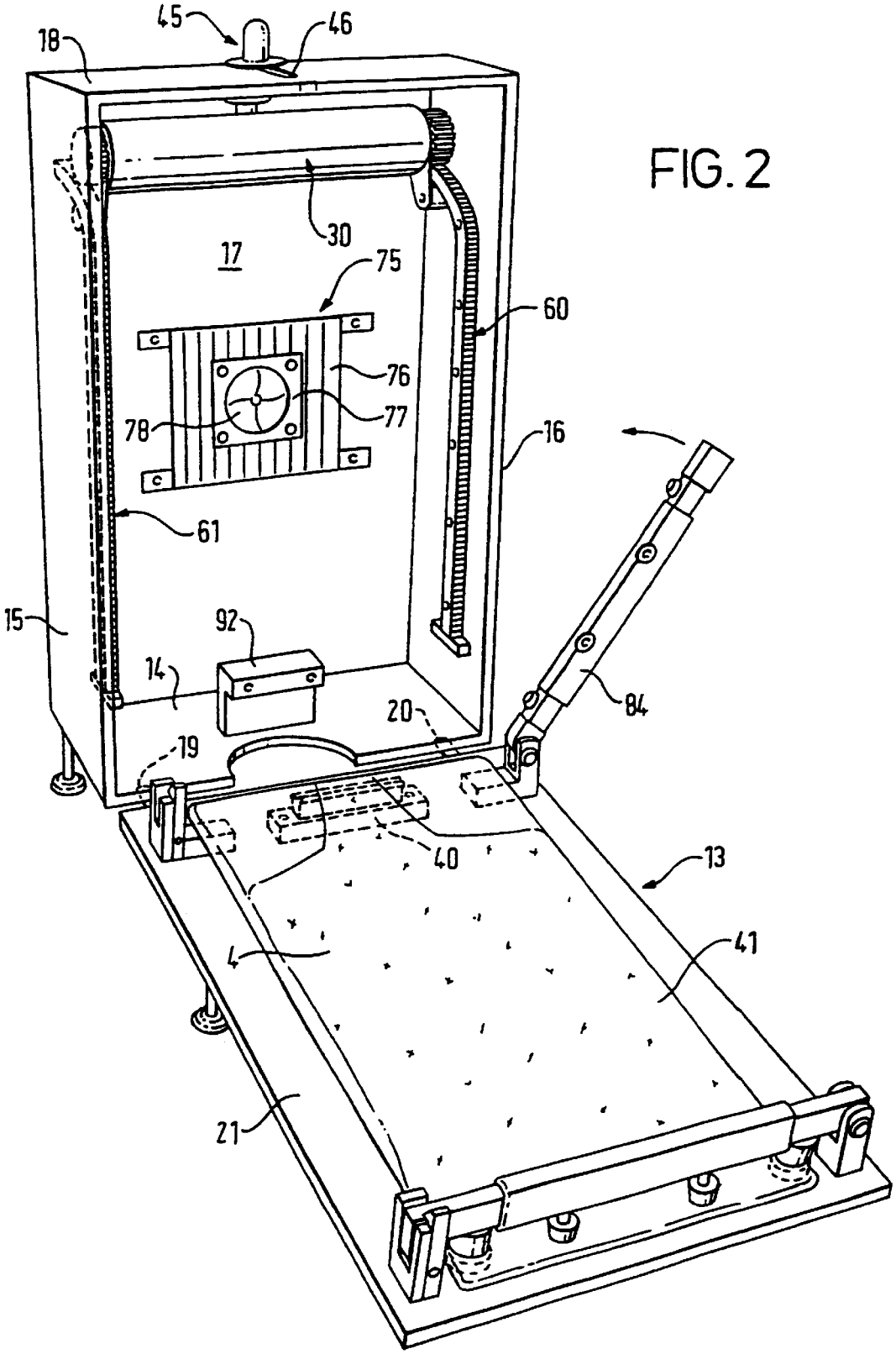
FIG. 2 is a perspective representation of the pumpless food dispenser with the front panel in open loading configuration.
Figure 6:
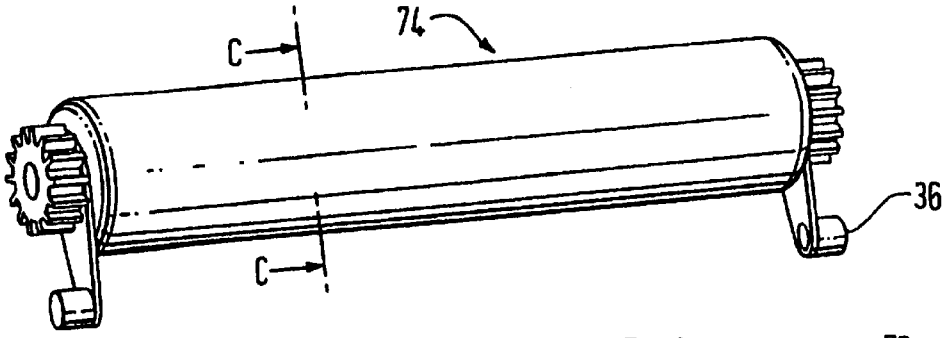
FIG. 6 is a perspective representation of the preferred mode of the roller means.

A viscous fluid dispenser according to the present invention is generally indicated by the reference numeral 10 in FIG. 1. As shown, dispenser 10 comprises two laterally spaced apart legs 11, a main housing 12 comprising the different functional components of the dispenser. As shown in FIG. 2, the housing comprises a front moveable panel 13, a bottom panel 14, two side panels 15, 16, a rear panel 17 and a top panel 18. A manual actuating system 9 is provided in the front of the dispenser for delivering the food product by pulling action on a lever 904 as will be described in greater details later in the present description. According to one beneficial aspect of the invention, the front panel 13 is arranged to freely pivot from an upright closed position to a substantially horizontal position of loading. For that the front panel 13 has a bottom part which is secured by means of hinges 19, 20 to the inner lateral surfaces of the legs 11. In an alternative, the hinges could also be attached to the bottom panel as well. The front panel further includes, at its upper edge opposite to the lower hinged edge, a locking member 51 which cooperate in closure with the upper panel 18.

The dispenser comprises means for pressing the main reservoir of a pouch 4 so as to provoke the extrusion of the food product by an outlet 40, generally positioned at the lower end of the main reservoir of the pouch as illustrated in FIG. 2. These pressing means preferably include a single roller 30 capable to be positionable adjacent along substantially the all width of a first surface 410 of the pouch 4. The pressing means also include the inner surface 21 of the front panel 13 which so provide an interior planar surface upon which the opposed surface 411 of the pouch can take a solid planar support. It must be noted that this simple arrangement can be installed in a very reduced space of the dispenser leaving more space for other devices such as the heating or refrigerating devices or allowing producing less cumbersome dispensers.

Referring to FIGS. 2 to 6, the roller 30 comprises a main pressing central portion 31 of relatively large diameter and two side cylindrical engaging portions 32, 33. The engaging portion forms gear portions for guiding the roller along guide means of the housing. For that, two parallel guide means 60, 61 are disposed along each side of the housing and, preferably attached to the inner surfaces of the side panels 15, 16 by suitable connection means such as screws or rivets.

The guide means includes complementary engaging surfaces forming gear tracks for the engaging portions 32, 33 of the roller. The guide means 60, 61 are arranged with respect to the front panel 13 so as to guide the roller along a substantially vertical pressing path illustrated by downward direction D in the figures. The guide means have preferably a constant section with front engaging cog surfaces 62, smooth inner surfaces 63 and rear surfaces 64 (FIGS. 3 and 4). Retaining means 34, 35 of the roller are provided which are capable of engaging the guide means to prevent the roller from falling off the dispenser when the front panel is in open configuration. Indeed, it is important to prevent any part of the dispenser from falling out of the housing (such as on the ground) which would cause contamination or spoilage of the dispenser. More particularly, each retaining means 34, 35 are formed of a pair of substantially L-shaped members connecting on each side of the roller. Each member has a caster 36 forming a first retaining rounded surface arranged on the side opposed to the side of the gear surface of the gear track. Each member has also a second retaining surface 37 arranged parallel along the inner side 63 of the gearing track. The second retaining surface is a short plate connected in sandwich between the main roller part 31 and the engaging portions 32, 33 of the roller. The caster connects in a rotary relationship to the second retaining surface. The short plate 37 is connected to the roller in a loose configuration so as to be able to rotate along the roller main axis I, thereby preventing blocking problems when the roller travels along the guiding side tracks 60, 61.

As shown in FIG. 4, the guiding side tracks 60, 61 comprise a first rest portion 66 wherein the roller is capable of resting in a position away from the first surface of pouch. The rest portion 66 is preferably a substantially horizontally oriented portion of gear track of several centimeters. The rest portion connects to a second engaging portion 67 of the guiding tracks which is a substantially vertically oriented portion and spaced from a predetermined constant distance from the front panel. Both rest and engaging portions are continuously connected together by a curved transitional portion of gear track 68 to ensure a smooth passage of the roller and its retaining means from the rest position to the engaged operational position. It is important to note that the caster 36 should leave a gap with respect to the rear surface 64 of the guide tracks as the roller is maintained in pressure against the gear tracks simply by contact against the front panel when downwardly travelling along the pouch. Therefore, a sufficient gap prevents any blocking problem of the roller during the downward dispensing phase. However, the retaining means have proved to be particularly useful for avoiding accidental fall-off of the roller and also for ensuring a correct positioning of the roller when the roller is moved by the pushing mechanism from its rest position to its engaging position with no risks of misalignment. The retaining means also facilitates the repositioning of the roller after it has reached the lower end of the gear track, by manually lifting the roller along the gear tracks. The retaining means may further serve the purpose to stop the roller at the lower end of the gear track by abutting a larger section of the gear track.

Figure 8:
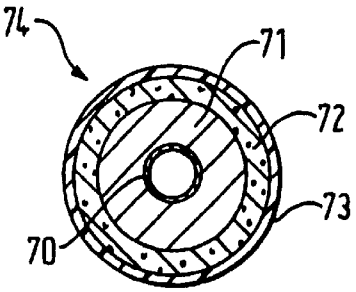
FIG. 8 is a cross-sectional view taken along line C—C of the roller means of FIG. 6.
Figure 5:
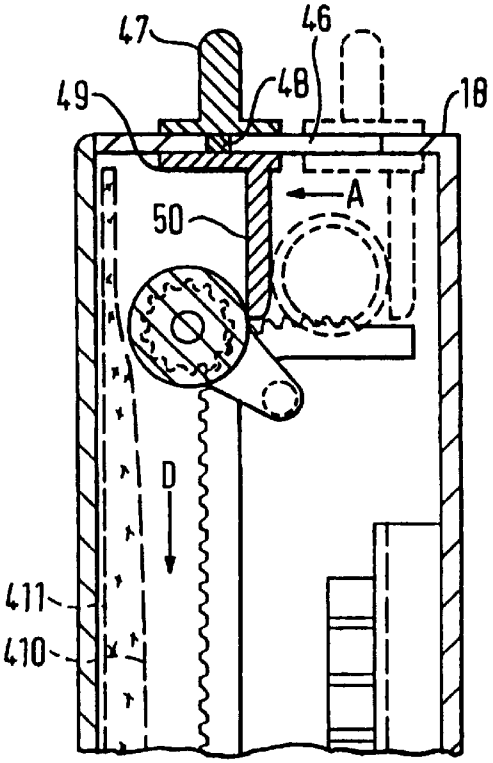
FIG. 5 is a schematic cross-sectional view taken along line B—B of the dispenser of FIG. 3 showing the roller means in engaging position after actuation of the pushing mechanism.

The roller can be moved from its rest position to its engaging position by a pushing assembly 45 rendered independent from the roller. The pushing assembly is arranged so that it is capable of being operated from the outside of the housing; i.e., while the housing is closed and the front panel properly locked for operating the dispensing. For that, a groove 46 is provided in the upper panel 18 of the housing which extends in a direction parallel to the two rest portions 66 of the gear tracks (FIG. 8). A lever 47 is mounted on the external side of the panel and extends downwardly by a rod 48 passing through the longitudinal groove 46. An inner support base 49 is provided for connecting the lower end of the rod; such support base extending downwardly by a pushing arm 50 of a length sufficient to contact the rear of the central portion of the roller. In use, the lever is actuated in a rear-to-front direction A as illustrated in FIG. 5 to move the roller from its rest position to its engaging position.

Figure 9:
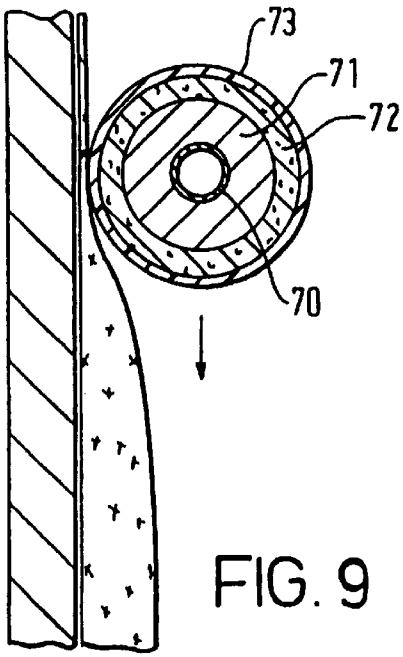
FIG. 9 is a schematic view representing the roller means in travelling along the pouch.
Figure 7:
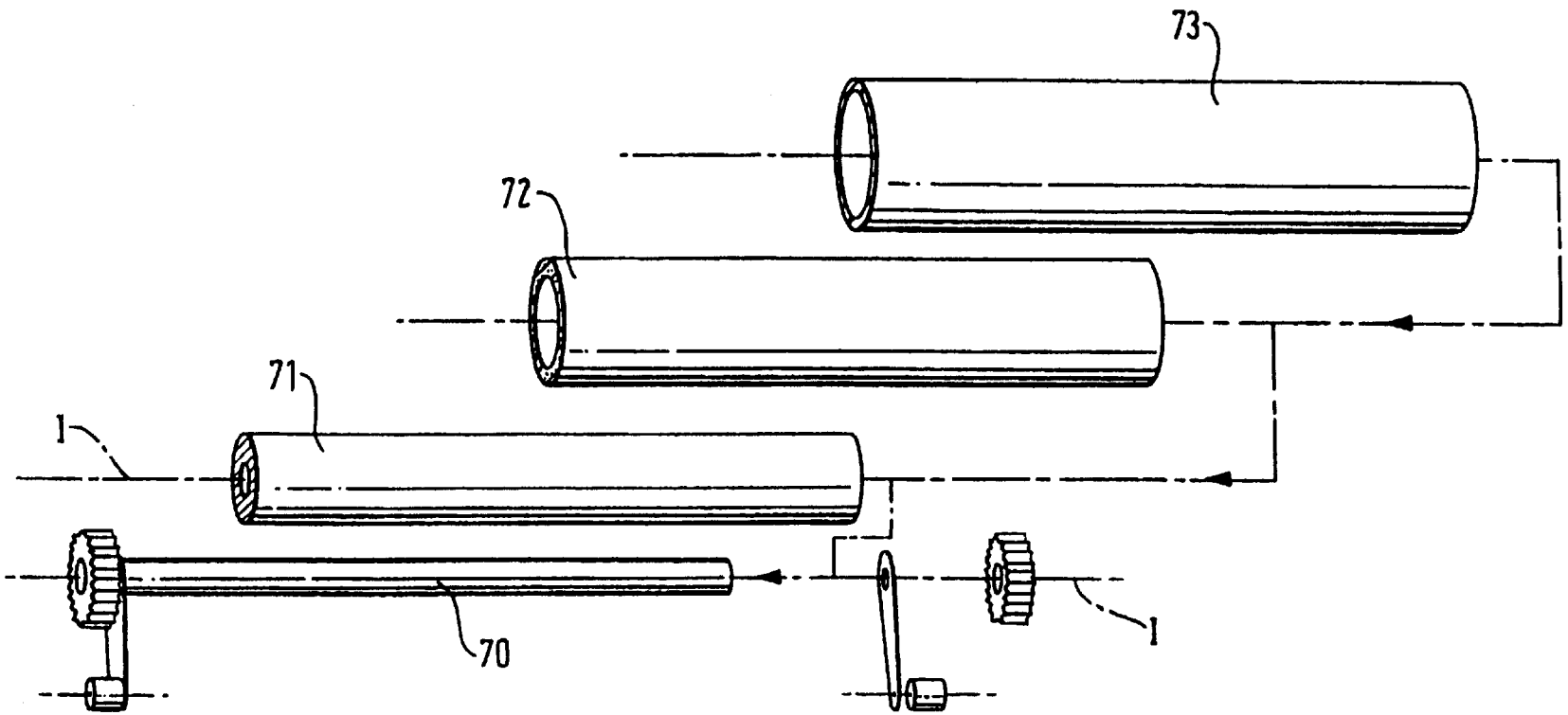
FIG. 7 is an exploded perspective view of the roller means of FIG. 6.

Referring now to FIGS. 7 to 9, the roller is formed of several assembled cylindrical elements. The main central pressing assembly of the roller is mounted on a central elongated axle 70. About the axle 70 is mounted a cylindrical weight 71 made of a heavy material, preferably, a high density metallic material, so as to confer to the roller a sufficient mass for moving along the pouch under the influence of gravity and consequently, is capable of inducing a sufficient flow through the outlet of the pouch. The weight can be of brass or lead or other equivalent high density metal. A compressible sheath 72 is further mounted around the weight. The sheath should be of a material soft enough to compress sufficiently under the pressure exerted by the roller on the pouch and front panel so as to keep moving over the wrinkles which generally form along the pouch in absence of compressible material. It has been determined that the material for the sheath has a hardness in the range of about 25 to 45 shore A, preferably 28 to 35 shore A, more preferably of about 30 shore A. The material for the sheath is preferably a rubber or foam plastic having resilient and insulation properties. It has been determined that depending upon various factors (viscosity, flow, roller mass, etc.) the roller may reduce its overall diameter from 0.1 to 5% due to compression effect. Successful results have been obtained with a closed cell silicone rubber sheath of 6 to 6.5 cm. Tests carried out by the applicant has shown 5–10% improvement of the evacuation rate as compared to a non-compressible roller means.

The outer gliding surface 74 of the pressing portion of the roller is preferably formed by an outer plastic resistant film 73. More preferably, the film is a heat-shrink thin tube of polyolefin or other suitable plastic materials. The film is placed around the surface of the sheath in an expanded configuration and recovered by applying heat, such as with a heat gun, until it shrinks around the sheath. Good results have been obtained with a polyolefin thin wall tubing of 1.5 mm and a shrink ratio of 2:1 (measured at a shrink temperature of 121° F.).

FIG. 9 shows the roller surface as it compresses against the front panel with the pouch therebetween. As opposed to the state-of-the-art pumpless dispensers, the compression effect enables a minimal extrusion thickness with no gap left between the pressing means, thereby reducing the negative impact of the wrinkles at the surface of the pouch. Wrinkles have shown as providing obstacles to a complete evacuation of the food product. The compressible roller prevents large wrinkles from forming and further rolls over the medium and small-size wrinkles at the surface of the pouch thus limiting the risks of blocking of the roller along the pouch during dispense. Of course, the roller weight is dimensioned as a function of the viscosity of the product to be extruded. For example, a roller having a total mass of 900 grams will be suited to extrude a fluid having a viscosity ranging from about 14 cm to 27 cm as measured by the Bostwick method at 82° C.

FIGS. 10 to 16 illustrate a preferred mode for an easy-to-load assembly intended to provide more convenience and also improve performance of the dispenser of the invention. As previously mentioned a front panel 13 is provided which includes an inner support surface 21 adapted to receive a food filled pouch 4 in a position adjacent to the support surface 21. The front panel is made moveable by hinge means 19, 20 between the loading position of FIGS. 2 and 10, whereby the pouch is capable to be laid at rest on the support surface and, the dispensing position of FIG. 1, whereby the outlet is positioned in a downwardly oriented configuration of dispense.

Therefore, there is a need for a quick latching system capable to secure the pouch in its loading substantially horizontal position. For that, connecting means 8 are provided on the inner surface of the front panel which preferably comprise a pair of clamping assemblies positioned in vertically spaced apart locations of the front panel when the panel is locked in dispensing operation. In particular, a first upper clamping assembly 81 is provided in the upper region of the front panel which includes a transversally oriented bar-shaped pressing member 82 having a first end 820 pivotally attached close to one lateral end of the panel and a second end 821 adapted to engage, in a removable manner, a latch member 83 attached in the vicinity of the opposed lateral end of the panel 13. The upper bar-shaped pressing member 82 is capable of exerting a connection on the upper transverse flange 42 of the pouch along at least two spaced apart positions along the seal flange 42 of the pouch. In particular, the upper flange 42 pouch is intended to have two holes in which can cooperate two male protruding pins 822 with a larger base attached to the surface of the panel. On the other side, the bar-shaped member is provided with two complementary shaped female tube portions 824 which fit in the thinner section of the pins 822 and press the pouch on the larger base of the pins upon closure of the bar-shaped member 82 has been completed by rotation. Additional relatively soft pressure means 825 can be distributed along the bar to improve the connection with the pouch by simply pressing the flange on the inner surface of the panel. The free end 821 of the bar-shaped member is locked in a latch member 83 such as the one illustrated in FIGS. 13 and 14. Such member may be formed of a U-shaped section of plastic having an elastic arm member 830 with a ramp portion 831 and a base portion 832 secured to the U-shaped section. Compression of the bar-shaped member against the ramp portion 831 of the elastic arm member causes the elastic arm member to move away from the other fixed opposed arm 833 of the section until the bar shaped member engages the opening 834. Then, the elastic arm member returns to its initial position and the bar-shaped member is blocked by the securing portion 832 which so prevents any release in upward direction unless a manual force is applied in transverse pulling direction B on the elastic arm member 830.

Figure 10:
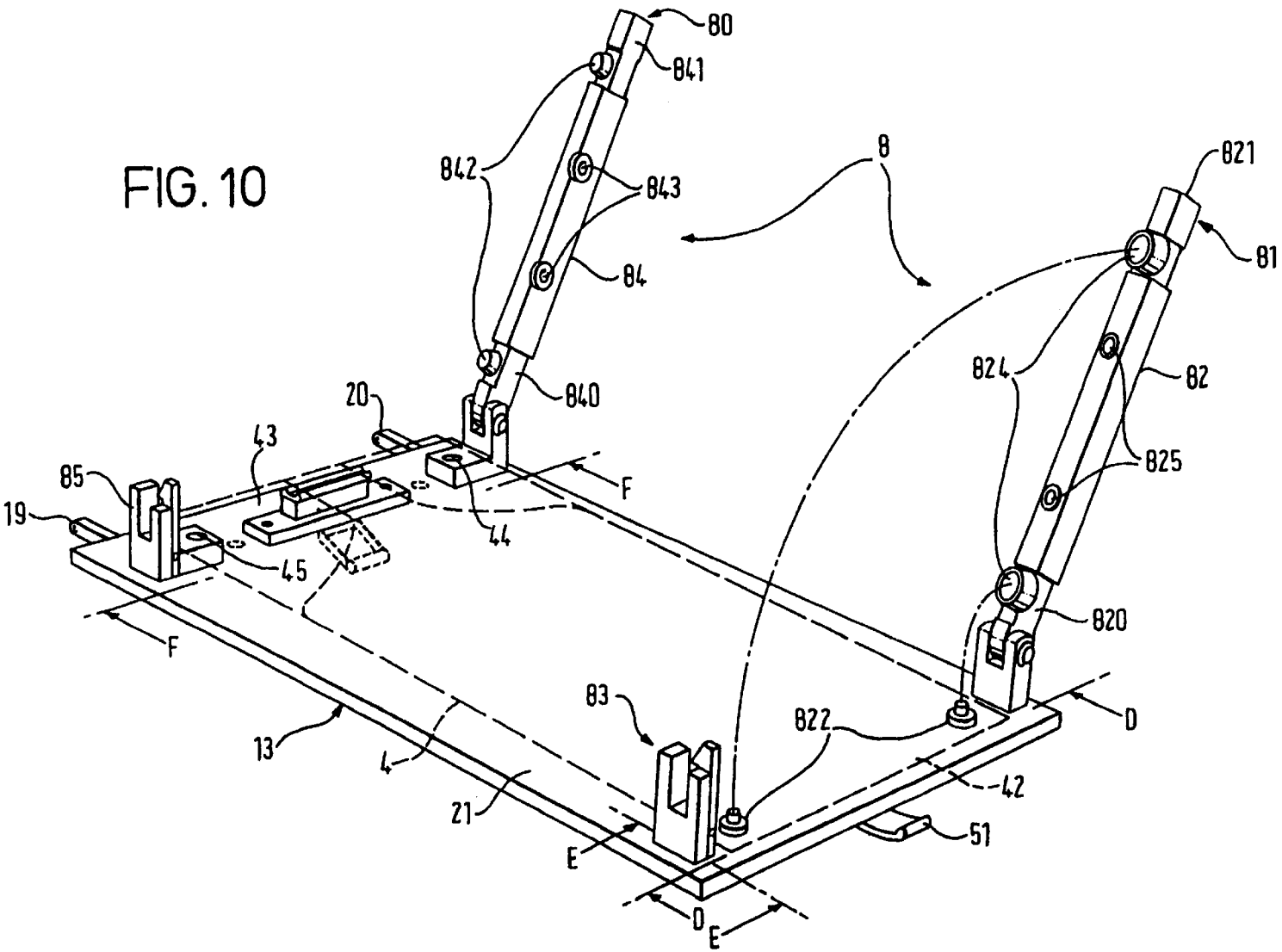
FIG. 10 is a perspective representation of the front panel with its clamping assemblies in open position with the pouch represented in dotted lines.
Figure 11:
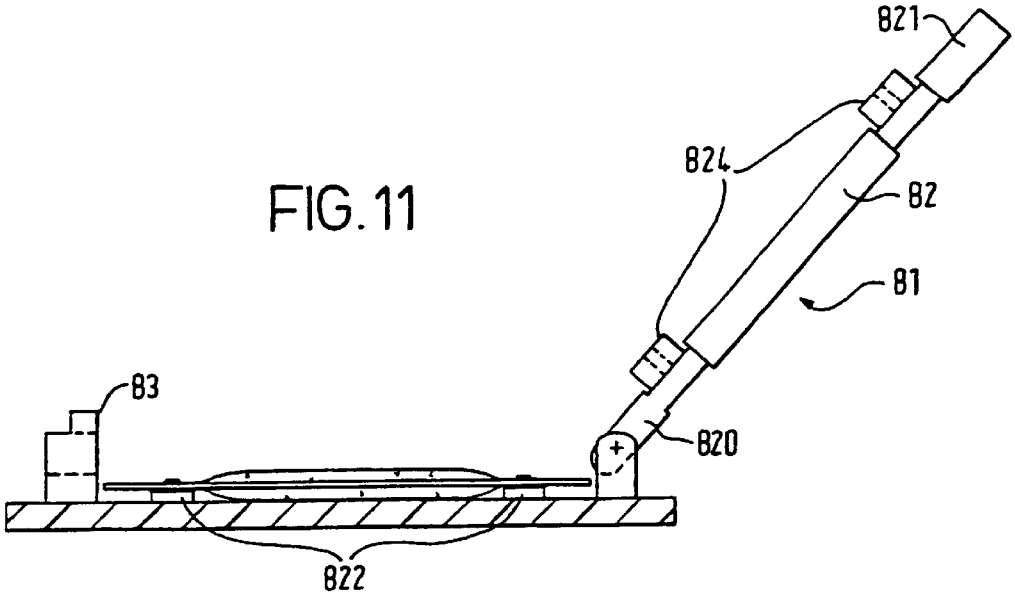
FIG. 11 is a schematic cross sectional view of the upper part of the moveable panel along line D—D with the pouch installed and the upper clamping assembly opened.
Figure 12:
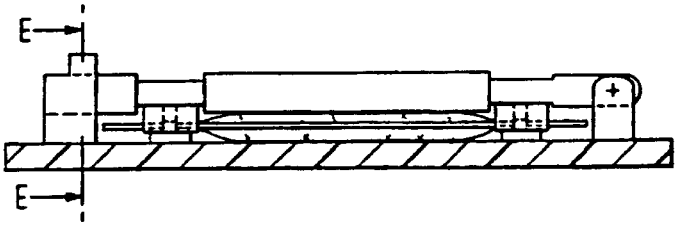
FIG. 12 is a schematic cross sectional view of the upper part of the moveable panel along line D—D with the pouch installed and the upper clamping assembly closed.
Figure 13:
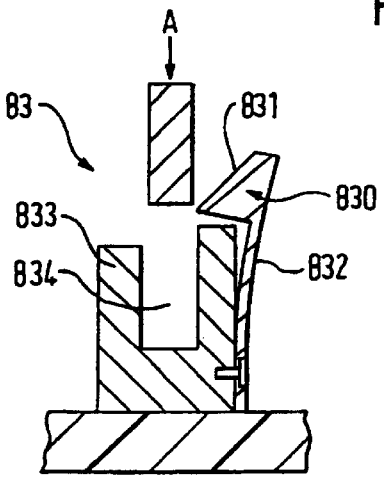
FIG. 13 shows the locking of the clamping assembly taken along line E—E of FIG. 10 or 12, when the bar starts engaging the latch member.
Figure 14:
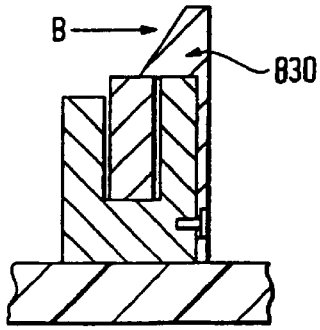
FIG. 14 shows the locking of the clamping assembly when the bar is secured in the latch member.
Figure 15:
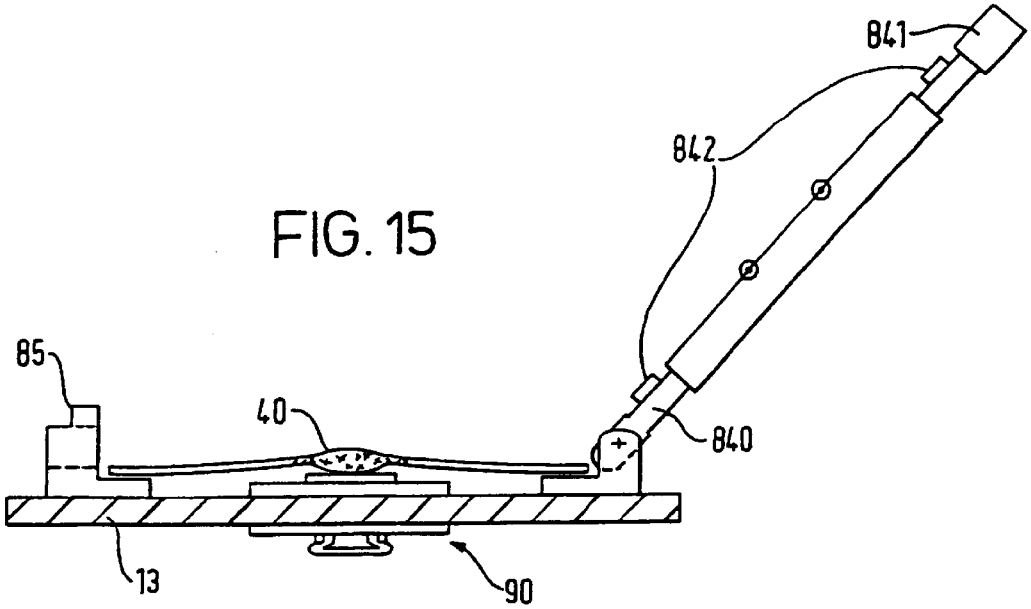
FIG. 15 is a schematic cross sectional view of the lower part of the moveable panel along line F—F of FIG. 10, with the pouch installed and the lower clamping assembly opened.
Figure 16:
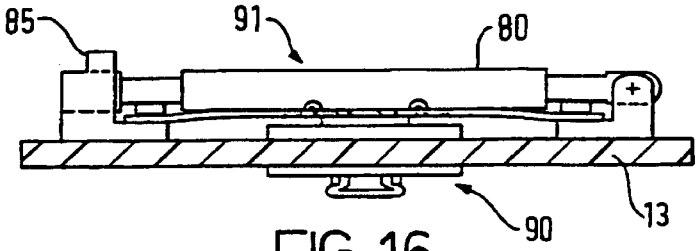
FIG. 16 is a schematic cross sectional view of the lower part of the moveable panel along line F—F of FIG. 10, with the pouch installed and the lower clamping assembly closed.

A second clamping assembly is preferably mounted in the lower region of the front panel 13 across the outlet portion 40 of the pouch as illustrated in FIGS. 10, 15 and 16. The clamping assembly also has a bar-shaped pressing member 84 having a first end 840 pivotally attached to the panel and a second end 841 adapted to engage a latch member 85 attached to the panel. The difference resides in the bar-shaped pressing member is capable to exert a connection by simple pressure on the side flanges 43 of the pouch along at least two transversally spaced apart positions 44, 45 of the pouch (illustrated in dotted circles). For that, the bar-shaped assembly is provided with two rubber pads 842 which protrudes from the bar-shaped member to engage in pressure on the pouch when the clamping assembly is closed. It should also be noted that the connection means of the second clamping assembly could also be identical to the connection means of the upper clamping assembly with the pouch provided with two or more holes in its lower flanges. Further pressing means may be added such as two transversally spaced apart disc-shaped portions 843 making edges located on each side of the outlet borderline so as to ensure a correct centering and positioning of the pouch in the dispensing system.

The dispenser of the invention is a one which includes a selectively openable closure means engaged with the outlet of the pouch for closing the outlet of the pouch. Upon actuation, the closure means is capable of opening the outlet so as to cause the roller to move along the pouch surface toward the outlet by gravity for expelling the viscous fluid food product through the outlet. Referring to FIGS. 15 and 16, the preferred closure means is a one having a first spring-biased half-valve sub-assembly 90 connected to the front moveable panel and a second stationary half-valve assembly 91; whereby the second half-valve assembly being the bar-shaped member 80 of the lower clamping assembly which is arranged in a face-to-face relation with respect to the first half-valve assembly 90. As a result of securing the lower part of the pouch on the front panel, the closure of the outlet of the pouch is furthermore obtained by assembling of the two half-valves together.

Referring again to FIG. 2, is shown a support bracket 92 which is provided as a stationary support member for supporting the second half-valve subassembly 90 and preventing it from bowing inwardly when the valve is actuated by pulling on the second half-valve assembly. Although the bar-shaped member 84 is a substantially rigid section of plastic or metal, the forces that are exerted locally when forcing the valve in opening, tend to cause a flexion or bowing effect on the bar and consequently may restrict the section of the outlet opening. The support bracket 92 may include an inverted L-shaped section and may be attached to the inner surface of the bottom panel 14 in the vicinity of the closing member. The bracket 92 is arranged in a position so that the front surface of the upper portion of the bracket abuts with the rear surface of the bar-shaped member 84.

Figure 17:
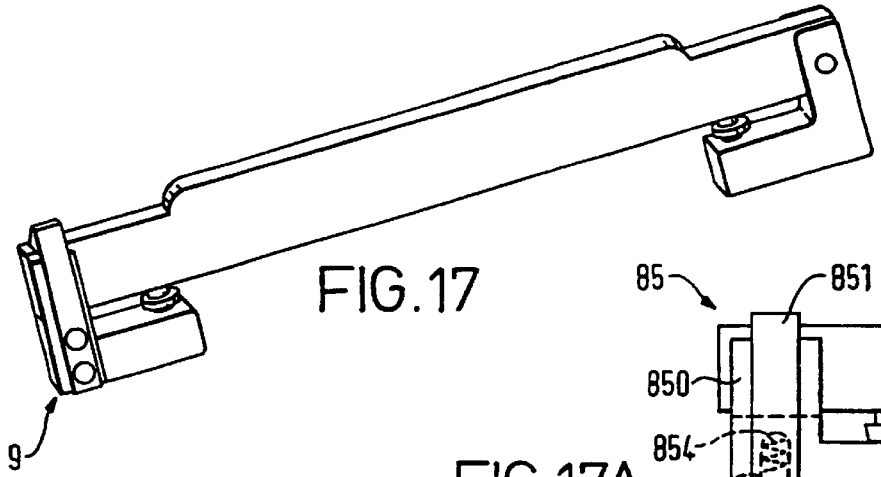
FIG. 17 is a perspective illustration of one part of the closure and clamping assembly for the outlet of the pouch according to a variant.
Figure 17A:
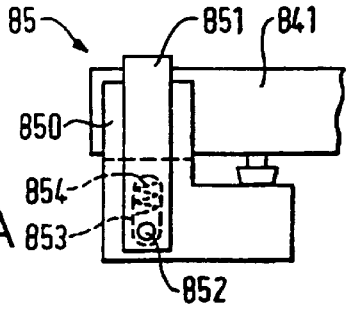
FIG. 17A shows the locking principle of the clamping part of FIG. 17.

FIGS. 17 and 17A illustrate a variant of the clamping assembly with a different latching mechanism. In this particular arrangement, the free end 841 of the bar is capable to engage a U-shaped base portion 850 of the latch member 85. A pivoting inverted U-shaped latch element 851 is further provided which is connected within an oblong aperture 853 of the base portion 850 along a moveable axis 852 in the oblong aperture 853 which is partly occupied by a spring member 854. The latch element is so made moveable from a latched position in which the latch element is urged in tensioned engagement with the free end 841 of the bar and a release position in which the latch element is disengaged by urging the latch element 851 against the force of a spring element 854.

Figure 18:
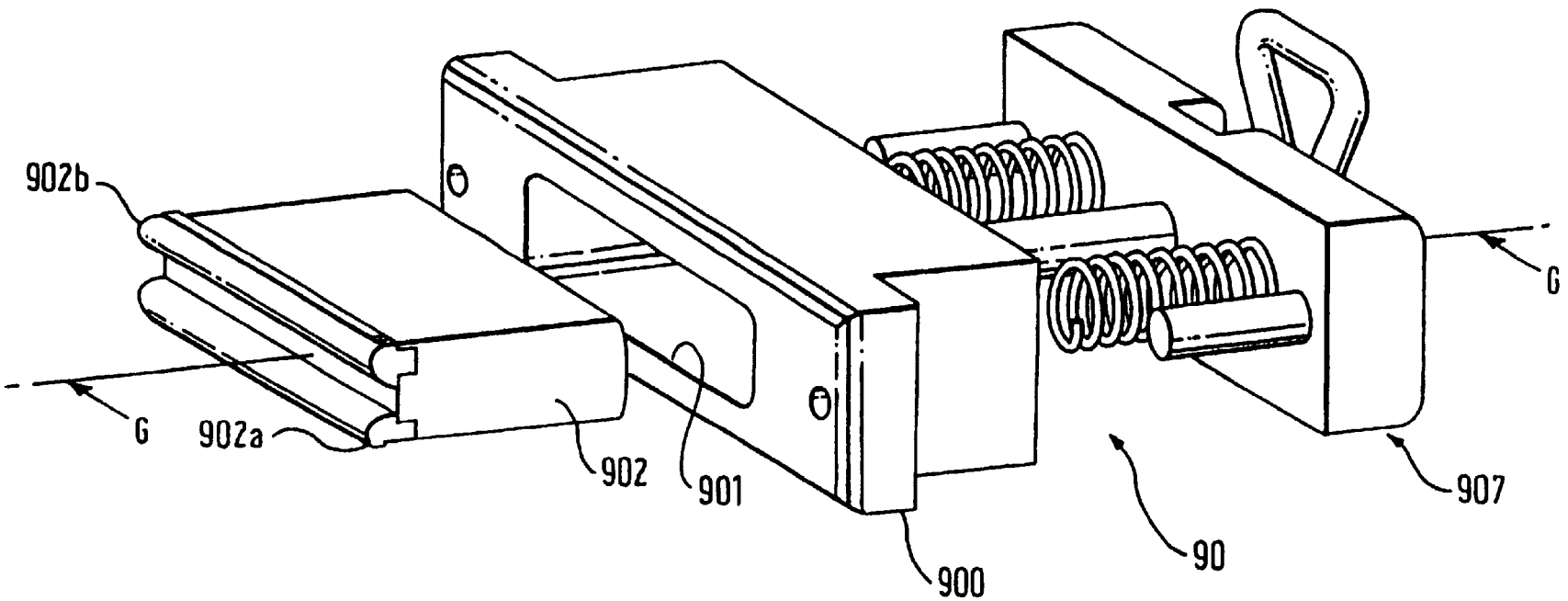
FIG. 18 is a perspective illustration of a first half valve of the closure means of FIG. 17.
Figure 19:
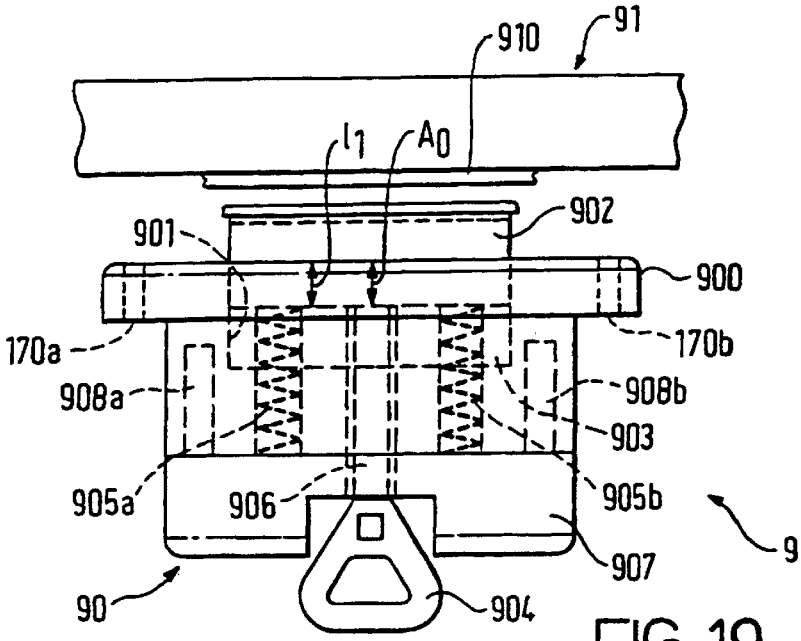
FIG. 19 is a cross-sectional view along line G—G of the closure means of FIG. 18.

FIGS. 18 and 19 show in detail the valve arrangement. First subassembly 90 comprises a base portion 900 connected to movable panel 13 by fixed connection means 170*a*, 170*b* such as screws and the like. A transversely oriented opening 901 is provided in front of base portion 901 which receives pressure member 902. Opening 900 has a depth longer than the length "$1_1$" of the engaged portion of member 902 so as to create sufficient room 903 to allow pressure member to slide in longitudinal direction $A_0$ upon actuation of front lever 904. A pair of compressive springs 905*a*, 905*b* are positioned between member 902 and a front support block 907. These resilient members 905*a*, 905*b* have the function of maintaining sufficient pressure on pressure member to constantly force pressure member 902 against abutting surface 910 of the second half sub-assembly 91 in absence of counter-force exerted by actuation of lever 904. In the center of pressure member is provided a central connection with lever 904 via a protruding rod 906 which is connected to pressure member 902. The protruding rod 906 is secured to lever 904. Further guiding rods 908*a*, 908*b* may be advantageously provided which protrude from the support block 907 toward the base portion 900.

In order to improve the sealing of the outlet of the pouch by the closure means, the engaged portion 902 comprises preferably a pair of transversally oriented elongated resilient bands 902*a*, 902*b*. The bands are installed to the face of the portion 902 that press the pouch against the bar-shaped member 91. The two bands are spaced apart one another in the direction of the product flow so as to close the outlet along two distant zones, thereby ensuring a safer closure. The two bands are preferably made of silicone rubber or any similar rubber material. The bands may be inserted by a dove-tail assembly to the engaged portion 902 and/or may be glued or welded to the engaged portion 902.

Figure 20:
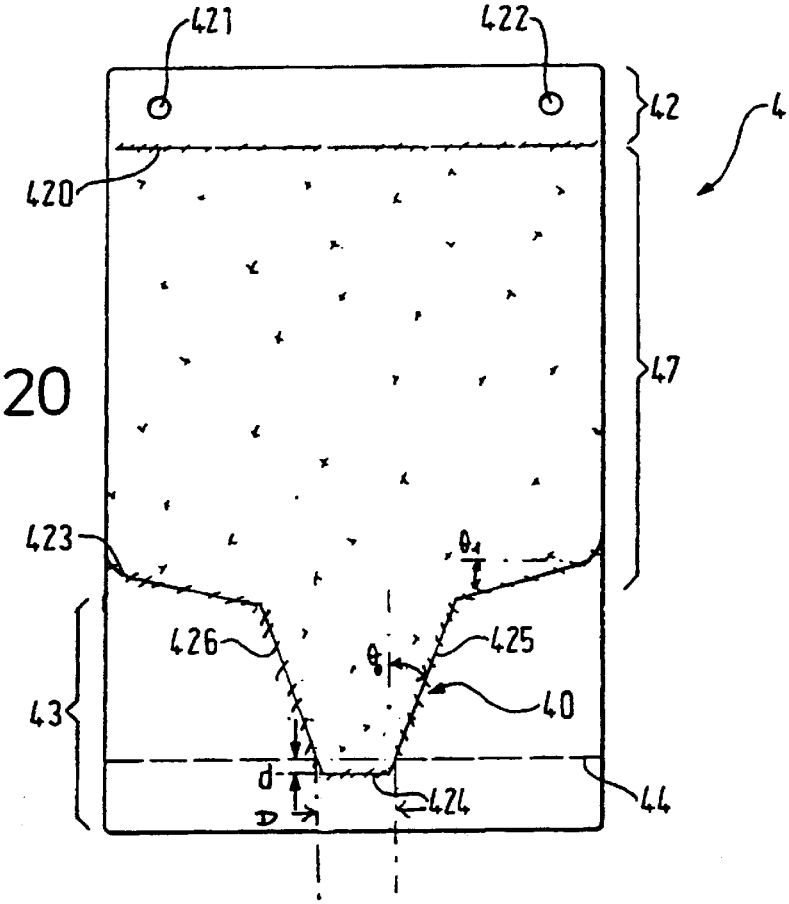
FIG. 20 is a front view of a pouch of the invention in a preferred mode.

FIG. 20 illustrates a preferred configuration of the supple fitmentless pouch of the invention. The pouch comprises a main reservoir or body 47 adapted for receiving the viscous fluid product and an outlet portion 40 integrally extending from the lower part of the main reservoir. Preferably, the main reservoir has a substantially constant width or cross section so as to allow a substantially even flow rate to be dispensed. The pouch is made by the sealing assembly of one or more flat plastic films. In a preferred embodiment, the pouch includes a first upper flange 42 of several millimeters to several centimeters. The upper flange closes the upper part of the pouch along an upper transverse heat seal 420. Two holes 421, 422 are provided along the flange width so as to allow the pouch to be secured in the upper clamping assembly as aforementioned. The pouch further has a lower seal flange 43 adapted to demarcate the contour of the lower limit of the reservoir or body including the outlet 40 of the pouch. More particularly, the outlet has a substantially downwardly tapered shape. For that, the outlet is demarcated by a lower heat seal 423 including lateral substantially tapered seal lines 425, 426 ending by a transverse closure seal line 424 at the lowermost end of the outlet; the seal line 424 being smaller than the upper part of the outlet due to the tapering configuration of the outlet. The outlet is made openable by means of a pre-cut line 44 provided along the all width of the lower flange 43 at a certain distance "d" above the closure seal line 424. The pre-cut line can be made by any suitable technique such as laser or mechanical cutting.

The width D of the outlet, as measured at the limit of the pre-cut line 44, has proved to be critical for the control and accuracy of the flow. It is advantageous to have a width D of from $1^{1/4}$ to 2 inches (3.18 to 5.1 cm), and preferably of about $1^{1/2}$ inch (about 3.80 cm). At a width D below $1^{1/4}$ inch, the flow rate was poor with the outlet bending at the point where the body 47 and the outlet 40 merge together which, consequently stopped the roller. The flow of product (volume) from the body to the outlet was also a problem. As the nozzle outlet size increases, the flow from the body to the outlet improves. A larger nozzle outlet ($1^{1/2}$ inch) was found to be able to better handle the large volume of product that was coming from the body. The flow and portion accuracy also improved. When the nozzle outlet size is increased to above 2 inches, controlling the flow with a very large portion at the end becomes more difficult. Tests have also shown that the inclination of the tapered seal lines has a positive effect on the accuracy and control of the flow rate. It has been found advantageous to have an angle $\theta_0$ of the seal lines 425, 426 demarcating the outlet with respect to the longitudinal direction of the pouch of from about 18 to 22 degrees, and preferably at 20°. Similarly, the angle $\theta_1$ of the lower seal lines of the body should have an angle of from about 22 to 28°.

It must be noted that the shape and configuration of the pouch may be subjected to various modifications without departing from the scope of the invention. The material of the pouch can be adapted to the type of food and storage conditions. However, preferred film materials for the pouch are those having oxygen and vapor barriers. For instance, the film can be selected among Nylon/EVOH/LLPDE or PP/EVOH/PP or PP/EVOH/LLPDE. The film thickness can advantageously be between about 0.05 to 0.2 mm.

The operation for loading the pouch in the dispenser of the invention is particularly convenient. With the operator standing in front of the dispenser, the front door is opened by unlocking the latch 51 and any additional latches that could be found suitable. The front door is allowed to open fully and rest on the dispenser legs 11. The clamping system is lifted from the operator by unlatching them and lifting them in upright position. The pouch is placed on the front panel inner surface with the upper holes of the upper flange of the pouch aligned over the pegs or pins of the panel with the outlet of the pouch facing away from the operator. The bottom edge of the pouch is then handled by the operator and the pouch is slightly pulled apart to make the pouch as "flat" as possible on the surface and making sure the outlet of the pouch resides within the edges of the lower clamping member and the valve base. With the other hand, the operator closes the lower clamping assembly by laying the clamp member back down over the pouch lower flange and latching it (There will be a "snap" as the member is engaged into position). The operation is repeated with the clamping assembly furthermost from the operator; i.e., the upper clamping assembly. The pouch is slightly maintained under tension while placing the clamping assemblies in the locked position. With the pouch locked in position, the bottom of the pouch is torn off across the laser score line. The front panel can then be raised with the pouch attached and attach by latch 51. In the next step, the roller is engaged by pulling firmly the lever 47 of the pushing assembly. The product is now ready to dispense. To dispense the product, one simply needs to pull down on the lever 904 of the actuating system 9. The dispensing cycle is complete when the roller has reached the bottom of the gear tracks and no longer travels.

In an alternative, the manual actuating system 9 could be replaced by a portion control device comprising solenoid means controlled by a timer for delivering a pre-set portion of fluid through the valve means (not shown).

Figure 21:
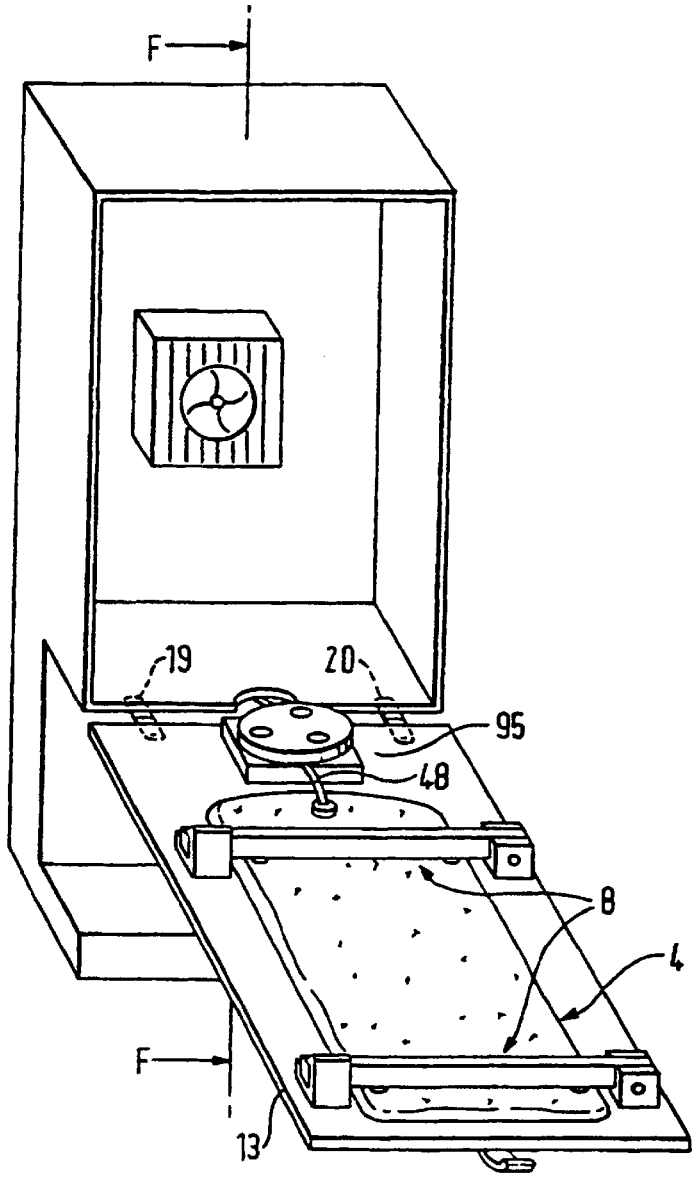
FIG. 21 is a schematic perspective view of a pump dispenser with a pouch in the loading position.
Figure 22:
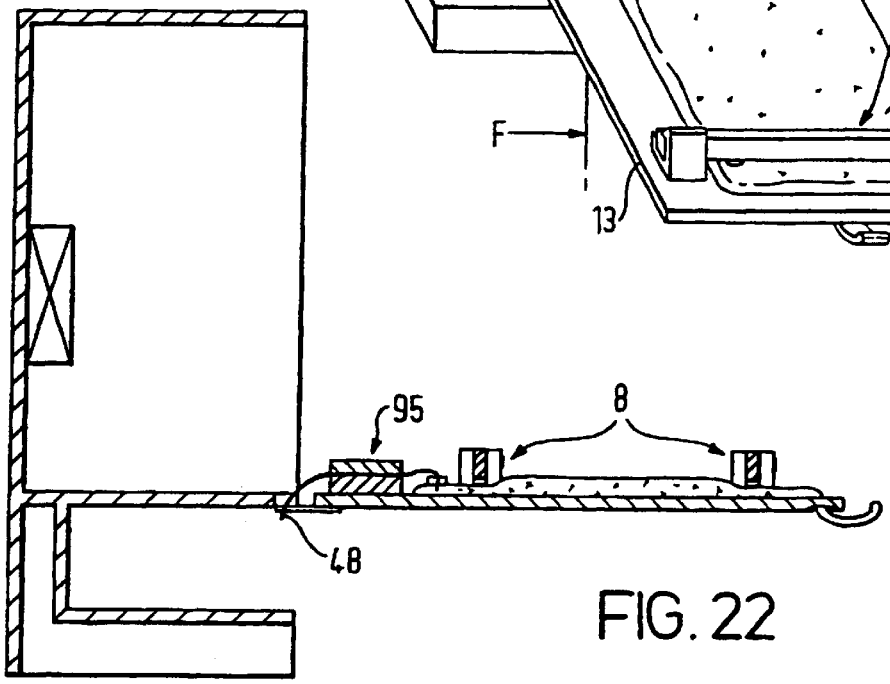
FIG. 22 is a schematic cross section view along line F—F of the dispenser of FIG. 21.

The easy-to-load feature of the present invention may also be applied in the context of a pump dispenser as illustrated by FIGS. 21 and 22. The dispenser, as shown, distinguishes from the previous embodiments by the fact it includes a pumping means, preferably a peristaltic pump 95. The pump is capable of being operatively connected to a flexible discharge tube 48 of the pouch 4. A front panel 13 of the dispenser is made moveable between an open position (loading position) and a closed position (operational position) along hinge means 19, 20 in a manner similar to the previous examples. The main portion of the pouch is secured onto the inner surface of the front panel by two longitudinally spaced apart connecting means 8 similar to those of FIGS. 10–16. The pump means are preferably also connected to the front panel, more particularly in the lower portion of the front panel, so as to allow the operator to insert the discharge hose 48 in position in the passage of the peristaltic pump. After these operations are carried out, the panel is moved in upright position and locked to the housing of the dispenser. The pump means can be of any suitable type. For instance, suitable peristaltic systems and/or pouches specially adapted therefore are described in U.S. Pat. Nos. 5,803,317; 6,003,7333; 6,016,935; and 6,024,252.

The device may also include means for thermally controlling the pouch at a constant temperature. In some cases, it is advantageous to raise rapidly and maintain the pouch at a relatively warm temperature as for cheese sauce, tomato sauce or similar. For that, heating elements 75 may advantageously complete the device. The heating elements 75 are installed, as shown in FIG. 2, inside the housing, for instance, they are attached to the inner surface of the rear panel 17 of the housing. The heating elements comprise an electrical heat device comprising a heat sink side 76 and an electrical resistance cartridge 77 on the opposite side. The resistance cartridge provides by conduction a certain amount of heat to the heat sink side. Heat accumulated by the heat sink is distributed in the housing by means of an air circulating means such as a fan 78. The fan helps the housing to be constantly maintained at a substantially homogeneous temperature and it favors dry hot air circulation inside the housing. In that case, heating of the pouch is mainly produced by convection. The resistance cartridge may be replaced by other heating sources such as resistance strips.

Figure 23:
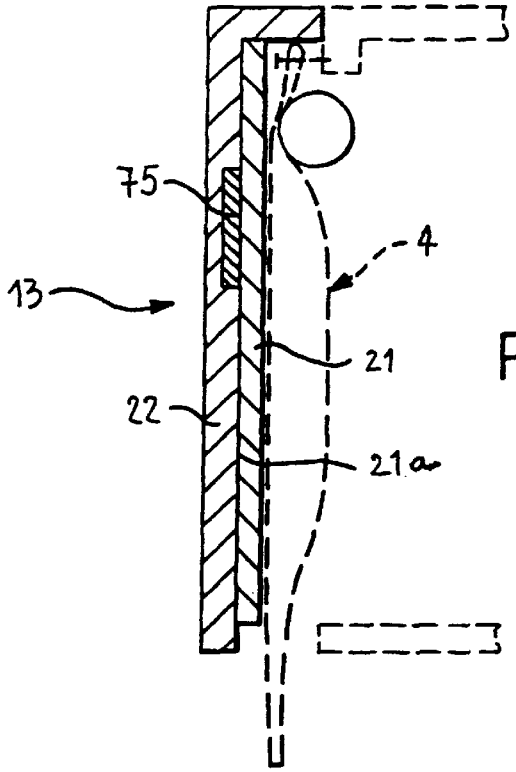
FIG. 23 is a diagrammatic partial cross-sectional view of the dispensing apparatus comprising a heating device.

In the embodiment illustrated in FIG. 23, the heating means may be applied by conduction effect to the pouch. For that, the planar surface 21 contacting the pouch can be thermally coupled to appropriate heating means 75. Heat is so provided by the constant contact of the pouch with the thermally conductive plate 21. Heating means 75 are preferably electrical resistance elements contacting the planar surface. The heating device may be adhesively attached on the outer side 21*a* of the planar surface 21. As illustrated, the heating element 75 may also be inserted between the planar surface 21 and a heat insulated external wall 22. The heating element is preferably of a size and power effective to properly and rapidly heat the planar surface. The heating element may preferably extend on the planar surface to about the same length as the planar surface or alternatively, may cover only partially the planar surface. Planar surface 21 and external wall 22 can form, for instance, the front door 13 of the dispensing device.

The heating device may comprise adhesive strips or bands and electrical resistive elements connected therewith such as wires, mat or equivalents.

The roller also promotes the contact and so heat transfer from the plate to the pouch. The roller surface may be covered by a thermally insulated material to prevent or reduce caloric loss in direction to the roller. In another alternative, the roller can also be thermally regulated.

The conduction means can be employed either alone or to supplement the convection means. Tests carried out by the applicant have permitted to prove that the use of the combination of both heating modes could dramatically reduce the time necessary to set the temperature of the pouch at the right desired value from a cold pouch. For example, cheese sauce pouch or chilli containing pouch of 6 Lb (2.72 Kg) can be heated up from 70° F. (about 20° C.) to 140° F. (about 60° C.) using air convection mode only that would take approximately 1000 watts to heat the product in about 120 minutes. A pouch of the same size could be heated up to the same temperature of 140° F. (about 60° C.) using air convection and conduction mode, as previously described, that would need about 500 watts at the air heater and about 360 watts at the plate heater for a total of about 860 watts to increase the energy utilization by about 14%. If a 500-watt air heater and a 500-watt conduction plate heater for a total of 1000 watts are used in combination, the product would be heated in about 100 minutes only instead of 120 minutes.

Figure 24:
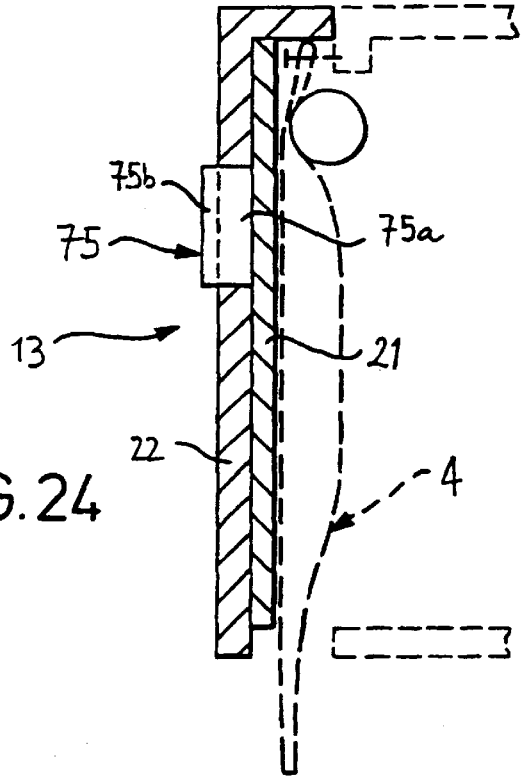
FIG. 24 is a diagrammatic partial cross-sectional view of the dispensing apparatus comprising a cooling device.

In another embodiment illustrated in FIG. 24, the pouch may need to be cooled such as for certain refrigerated food products. For that, the heating means may be replaced by cooling means such as TEC's (Thermoelectric coolers) which permits regulated cold dispensing. The TEC 75 has a cold side 75*a* and a heat sink side 75*b*. The TEC is formed as a thermopile by connecting in series a plurality of thermocouples in a known manner: each thermocouple consisting of a p-type semi-conductor and a n-type semi-conductor electrically connected between two poles of a direct-current power supply to produce a cool junction on the cold side 75*a* and a warm junction on the heat sink side 75*b*. The TEC is also known as a thermoelectric module, a Peltier cooler or a thermoelectric heating/cooling device. In the context of the present invention, the cold side 75*a* of the TEC would be preferably coupled directly (as shown) or indirectly via a buffer block (not shown) to the planar surface 21 which contacts with the pouch 4 so as to provide conduction cooling of the pouch. Dissipation of the heat coming from the heat sink side is preferably achieved to atmosphere. The heat conductive plate 21 is preferably insulated from the outside by an insulated from outside by an insulated external wall 22 comprising resin material having good insulation properties.

The dispenser may be used in a wide variety of applications for dispensing generally food products. The food product can contain relatively small solid pieces approximately up to 12.7 mm in diameter in a viscous suspending matrix provided the extrusion of the product is still made possible by the dispenser. Preferably, the invention contemplates use of the dispenser assembly with food products having a viscosity generally in the range of from about 14 cm to about 27 cm as measured by the Bostwick method.

Other various embodiments are described in U.S. Pat. No. 6,194,420, which is expressly incorporated herein by reference. It is understood that various changes may be brought in adapting the invention to different embodiments without departing from the broader inventive concept disclosed herein and comprehended by the claims that follow.

What is claimed is:

1. A dispenser for a viscous fluid food product, the dispenser comprising:

a housing configured and dimensioned for receiving a pouch having first and second ends, a sidewall that can be arranged to form first and second opposed surfaces, and an outlet, the pouch containing a viscous fluid food product therein;

means for pressing the pouch so as to dispense the viscous fluid food product through the outlet, the pressing means comprising at least one roller means that has a main pressing assembly of sufficient mass for moving along the pouch under the influence of gravity and for inducing a flow of the product through the outlet upon demand, and a compressive pressing surface positionable in a position of contact with the first surface of the pouch, guiding means operatively associated with the roller means so as to guide the roller means in translation along a pressing path adjacent the first surface of the pouch; and retaining means coupled to the roller means and arranged to prevent the roller means from disengaging the guiding means when the roller is at rest in the dispenser; wherein both the guiding means and retaining means are housed within the housing.

2. A dispenser for a viscous fluid food product, the dispenser comprising:

a housing configured and dimensioned for receiving a food pouch; the pouch having first and second ends, a sidewall that can be arranged to form first and second opposed surfaces, and an outlet, the pouch being capable of containing a viscous fluid food product therein;

means for pressing the pouch to dispense the viscous fluid food product through the outlet; wherein the pressing means comprises a main pressing assembly of sufficient mass for moving along the pouch under the influence of gravity to induce a sufficient flow of the food product through the pouch outlet, and a compressible pressing surface that is positioned adjacent the first surface of the pouch;

a planar surface disposed adjacent the second surface of the pouch; and closure means engaged with the outlet for closing the outlet, the closure means being capable of opening the outlet so as to cause the main pressing assembly to move along the pouch toward the outlet by gravity for dispensing the viscous fluid food product through the outlet;

wherein the housing includes guide means for the pressing means, and the pressing means comprises a roller having engaging portions which form gear portions for guiding the roller along the housing guide means, with the guide means comprising complementary engaging surfaces that form gear tracks for the gear portions of the roller.

3. A dispenser according to claim 2, wherein the planar surface is substantially vertically arranged along at least a major portion of the sidewall of the pouch, the roller contacting the pouch at the first end, ad the pouch outlet is positioned at the second end of the pouch.

4. A dispenser according to claim 3, wherein the planar surface constitutes an interior surface of at least a portion of a wall of the housing.

5. A dispenser according claim 4, wherein the roller is formed of an elongated main cylindrical portion comprising an inner weight and an outer sheath of a soft resilient compressible material.

6. A dispenser according to claim 5, wherein the outer sheath is made of compressible material having a hardness in the range of 25 to 45 shore A.

7. A dispenser according to claim 5, wherein the soft resilient material is an insulated silicone rubber.

8. A dispenser according to claim 5, wherein the main portion of the roller further includes an external gliding surface made of a plastic film.

9. A dispenser according to claim 8, wherein the gliding surface plastic film is heat-shrunk around the outer sheath of soft compressible material.

10. A dispenser according to claim 9, wherein the plastic film is a polyolefin film.

11. The dispenser of claim 2 in combination with a fitmentless pouch which comprises a main reservoir adapted for receiving a viscous fluid product and an outlet portion having an upper section integrally extending from the lower part of the main reservoir, a sealing assembly that includes at least one plastic film having at least a lower seal flange adapted to demarcate the contour of the lower limit of the reservoir including the outlet portion, wherein the pouch further comprises an upper flange that adapted for being hung dispensing device in the housing with the outlet oriented in a dispensing position such that the flow of the viscous fluid food product is assisted by gravity, and the outlet is demarcated by a tapered heat seal at the lower part of the reservoir forming an angle of inclination ($\theta_1$) with respect to a transverse direction and tapered seal lines forming an angle of inclination ($\theta_0$) with respect to a longitudinal direction and ending at a transverse closure seal which is smaller than the upper section of the outlet.

12. The dispenser of claim 11, wherein the angle of inclination ($\theta_0$) of the tapered seal lines is between about 18 and 22 degrees.

13. The dispenser of claim 11, wherein the angle of inclination ($\theta_0$) of the tapered heat seal is between about 22 and 28 degrees.

14. The dispenser of claim 11, wherein the outlet of the pouch has a width of between about 3.18 and 5.1 cm.

15. The dispenser of claim 11, wherein the outlet includes a pre-cut line for opening the outlet, the pre-cut line being provided along the lower seal flange at a preselected distance above the closure seal line.

16. The dispenser of claim 15, wherein the pre-cut line is made by laser or by mechanical cutting.

17. A dispenser for a viscous fluid food product, the dispenser comprising:

a housing configured and dimensioned for receiving a pouch having first and second ends, a sidewall that can be arranged to form first and second opposed surfaces, and an outlet, the pouch containing a viscous fluid food product therein; the housing comprising at least one panel comprising a support surface adapted to receive the pouch in a position adjacent to the support surface; the panel being moveable between a loading position whereby the pouch is capable to be laid at rest on the support surface and a dispensing position whereby the outlet is downwardly oriented configuration; and connecting means for securing the pouch onto the support surface of the moveable panel so that the pouch is maintained substantially adjacent to the support surface when moving the panel from its loading position to its dispensing position, wherein the connecting means comprises at least one clamping assembly comprising a bar-shaped pressing member capable of exerting a pressure along at least two spaced apart positions along a portion of the pouch.

18. A dispenser according to claim 17, wherein the moveable panel has a top edge and a bottom edge; wherein the bottom edge of the panel is pivotally attached to the housing by hinge means adapted to move the panel from its loading position to its dispensing position.

19. A dispenser according to claim 17, wherein the bar-shaped pressing member has a first end pivotally attached to the panel and a second end adapted to engage a latch member attached to the panel.

20. A dispenser according to claim 19, wherein the portion of the pouch is a seal flange of the pouch.

21. A dispenser according to claim 19, wherein the clamping assembly is positioned in the upper region of the panel to be capable to secure the upper seal flange of the pouch.

22. A dispenser according to claim 19, wherein the clamping assembly has a width adapted to support different sizes of pouch.

23. A dispenser according to claim 19, wherein a second clamping member is positioned in the lower region of the panel to secure the lower seal flange of the pouch.

24. A dispenser according to claim 23, wherein the second clamping assembly has a width adapted to support different sizes of pouch.

25. A dispenser according to claim 11, wherein the panel includes closure means for closing the outlet of the pouch, the closure means being capable of opening the outlet to dispense the food product upon application of sufficient pressure to release the closure means from the outlet of the pouch.

26. A dispenser according to claim 25, wherein the closure means comprises a first half valve sub-assembly attached to the moveable panel and a second half valve forming a stationary part of the closure means.

27. A dispenser according to claim 26, wherein the second half valve includes the bar shaped pressing member and is arranged in a face-to-face relation with the first half-valve when the clamping member is in closed position to secure the lower part of the pouch.

* * * * *